US009228739B2

(12) United States Patent
Barudi et al.

(10) Patent No.: US 9,228,739 B2
(45) Date of Patent: Jan. 5, 2016

(54) AUTOMATIC FUELING OF LIQUID FUEL BURNERS

(75) Inventors: Samir Barudi, Huntington Beach, CA (US); David Merrill, Mount Vernon, CA (US); Chris Caron, Stockton, CA (US)

(73) Assignee: Duraflame, Inc., Stockton, CA (US)

( * ) Notice: Subject to any disclaimer, the term of this patent is extended or adjusted under 35 U.S.C. 154(b) by 830 days.

(21) Appl. No.: 13/102,857

(22) Filed: May 6, 2011

(65) Prior Publication Data

US 2012/0282559 A1 Nov. 8, 2012

(51) Int. Cl.

| | |
|---|---|
| ***F24B 7/00*** | (2006.01) |
| ***F23D 5/04*** | (2006.01) |
| ***F23K 5/14*** | (2006.01) |
| ***F24C 5/18*** | (2006.01) |

(52) U.S. Cl.
CPC ... *F23D 5/04* (2013.01); *F23K 5/14* (2013.01); *F24C 5/18* (2013.01)

(58) Field of Classification Search
CPC ..... F24B 1/99; F23C 5/001
USPC ..... 126/92 R, 92 AC, 127, 51; 431/12, 125, 431/11, 123
See application file for complete search history.

(56) References Cited

U.S. PATENT DOCUMENTS

| | | | | |
|---|---|---|---|---|
| 1,378,689 | A * | 5/1921 | Larson | 431/334 |
| 4,381,759 | A * | 5/1983 | Faustini | F24B 1/1886 126/152 B |
| 4,582,478 | A * | 4/1986 | Hilker | 431/125 |
| 4,637,372 | A * | 1/1987 | Mogol | F24C 3/006 126/512 |
| 4,838,781 | A | 6/1989 | Fischer | |
| 5,858,031 | A | 1/1999 | Perlman | |
| 6,267,113 | B1 | 7/2001 | Maust et al. | |
| 7,458,808 | B2 | 12/2008 | McCarren | |
| 8,622,053 | B2 * | 1/2014 | Nowak et al. | 126/44 |
| 9,086,220 | B2 * | 7/2015 | Husted | F24B 1/1808 |
| 2005/0092391 | A1 * | 5/2005 | Fesko | 141/331 |
| 2005/0178379 | A1 | 8/2005 | Weinberger | |
| 2006/0037604 | A1 | 2/2006 | Hoffmann et al. | |
| 2009/0241936 | A1 * | 10/2009 | Husted et al. | 126/512 |

(Continued)

FOREIGN PATENT DOCUMENTS

JP 02298705 A * 12/1990 ..... F23D 11/24

OTHER PUBLICATIONS

"Bioethanol fireplaces", ArchiExpo 2011, p. 1-4 (Mar. 23, 2011) <http://www.archiexpo.com/architecture-design-manufacturer/bioethanol-fireplace-3078.html>.
"Bioethanol fireplaces", ArchiExpo 2011, p. 1-3 (Mar. 23, 2011) <http://www.archiexpo.com/architecture-design-manufacturer/bioethanol-fireplace-3078-_.html>.
"FMI Products, LLC", p. 1-2, <www.fmiproducts.com >.

(Continued)

*Primary Examiner* — Gregory Huson
*Assistant Examiner* — Nikhil Mashruwala
(74) *Attorney, Agent, or Firm* — Koppel, Patrick, Heybl & Philpott; Michael J. Ram

(57) ABSTRACT

An assembly for creating a fire display from a liquid fuel comprises a fuel receiving reservoir connected to a burner by a conduit, the conduit providing a flow channel for a liquid fuel from the reservoir to the burner. When a container of liquid fuel is placed in a bottle receiving tray the fuel is dispensed into the reservoir and in turn flows into the burner. Flammable vapors over the liquid fuel in the burner can then be ignited. The arrangement provides a continuous feed of fuel to the burner and allows safe replacement of the fuel container and replenishment of the fuel in the burner while the flame is present.

13 Claims, 12 Drawing Sheets

(56) References Cited

U.S. PATENT DOCUMENTS

| | | | | |
|---|---|---|---|---|
| 2011/0048402 | A1 | 3/2011 | Houle | |
| 2012/0210998 | A1* | 8/2012 | Montini | 126/512 |
| 2013/0071795 | A1* | 3/2013 | Barudi | F23D 5/04 431/7 |
| 2014/0255857 | A1* | 9/2014 | Barudi | F23D 3/18 431/12 |

OTHER PUBLICATIONS

"Sterno", Wikipedia, p. 1-2 (Mar. 23, 2011) <http://en.wikipedia.org/wiki/Sterno>.

* cited by examiner

AUTOMATIC FUELING OF LIQUID FUEL BURNERS

BACKGROUND

The invention relates to liquid fuel indoor and outdoor fire displays, particularly burner assemblies configured to burn a liquid fuel, such as an alcohol, paraffinic oils, plant oils, and flammable petroleum products, either in a liquid or gel form.

Historically, alcohol burning hearth products (fireplaces, stoves, log sets, vessels for containing open flames, etc) comprise a burner that is filled with alcohol, usually a denatured ethanol, or in the alternative, cans of flammable gelled alcohol, that are then lit to create the flame. Depending on the configuration of the burner and the size of the fuel reservoir, once ignited the fuel will burn until consumed, generally for 1-4 hours. Some burner configurations include a damper that will allow the flame to be extinguished prior to full consumption by covering the flame and restricting access to air. To extend the burning time the user typically has to wait until the fuel has burned completely, or the flame is extinguished, and the burner has cooled down before adding more flammable liquid or replacement can of gelled fuel into the burner and lighting it again. This procedure presents a number of problems which include:

a) The possibility of spilling a highly volatile and flammable fluid on the fireplace or stove assembly and log set, which presents the possibility of unintended combustion thus creating an unsafe situation;
b) Spilling the fuel on a person's arm, clothing or on the floor which can also create a fire hazard;
c) Because the fuels are highly volatile, and it is the vapors off the fuel and not the liquid fuel itself that is burning, these vapors present a very serious risk of accidental ignition. This hazard requires the user to wait for the flame to extinguish and the burner to cool down before refueling to prevent vaporized fuel from spontaneously igniting during the filling process;
d) Additionally, ethanol, unless specifically blended with additives to provide a visible flame, tends to burn with a nearly invisible color, especially in well-lit areas, causing spills to be very dangerous since it is sometimes impossible to notice that the fuel has ignited. Certain burner assemblies are designed to create yellower flames that are more visible, especially after the fuel has been ignited for some time; the conditions that make the flame visible in the burner assembly do not exist to allow visualization of burning fuel spills;
e) The fuel level inside the burner of an ethanol burning assembly is constantly changing as the fuel is consumed and thus is not always at an optimum level for aesthetics or for clean combustion of the fuel.

These liquid fuel burners in many instances are used as unvented appliances in unvented spaces. As a result, the emissions from combustion end up in the room. Thus clean and complete combustion is very important. An improperly designed or operated liquid fuel burner, or the use of the wrong liquid fuel, can release fuel vapors and carbon monoxide into the room. As a result, consumers have been reluctant to use the currently available ethanol burners.

One product provides for pouring fuel into a reservoir that is then slid into the fireplace assembly from outside the burner assembly. However, this design still requires pouring the fuel from an open bottle, allows for the release of flammable vapors and does not safely allow additional fuel to be added while the fuel is burning.

SUMMARY

A particular advantage of the disclosed design is that it allows the user to replenish the fuel while the flame is burning without any hazard of fuel spill or vapor release. The device disclosed herein provides a fuel tray and fuel feed arrangement designed to keep the burning vapors above the fuel surface within a preferred range within in the burner for proper and complete combustion for a substantial portion of the time that a flame is being provided. Additionally, in one embodiment the burner has a sloping bottom (to the right and/or left of the unit) which allows the fuel to accumulate to the right and/or left of the center of the burner so that when the fuel in the burner is nearly consumed the user can see that the flame is no longer burning across the entire burner surface, thus providing a visible signal that the unit needs to be refilled. Alternatively, if more than one burner is used, one or more burners may be positioned lower than the other burners so that fuel in that burner continues to burn while other burners run out of fuel.

DETAILED DESCRIPTION

Disclosed herein are arrangements for feeding liquid fuel in indoor and outdoor fire displays. The arrangements are particularly suited to the delivery of alcohol based liquid fuels, particularly methanol, ethanol, butanol, etc. but are not so limited. Other liquid fuels can be used such as ester oils, plant oils, paraffinic compositions, and flammable petroleum products, either in a liquid or gel form. The fire displays may be in a fireplace or stove or free standing such as a fire pit or decorative flame display with or without artificial firelogs. As alternatives, the fire displays may include, in place of the artificial logs various media to enhance the decorative appearance of the fire display, such as glass beads, chunks or shards, stones, metal sculptures, water features, etc and various combinations thereof. The disclosure herein is directed to an arrangement for continuously feeding the liquid fuel and is not dependent on the decorative materials surrounding the burner and the burning vapors emanating from the fuel.

Figure 1:
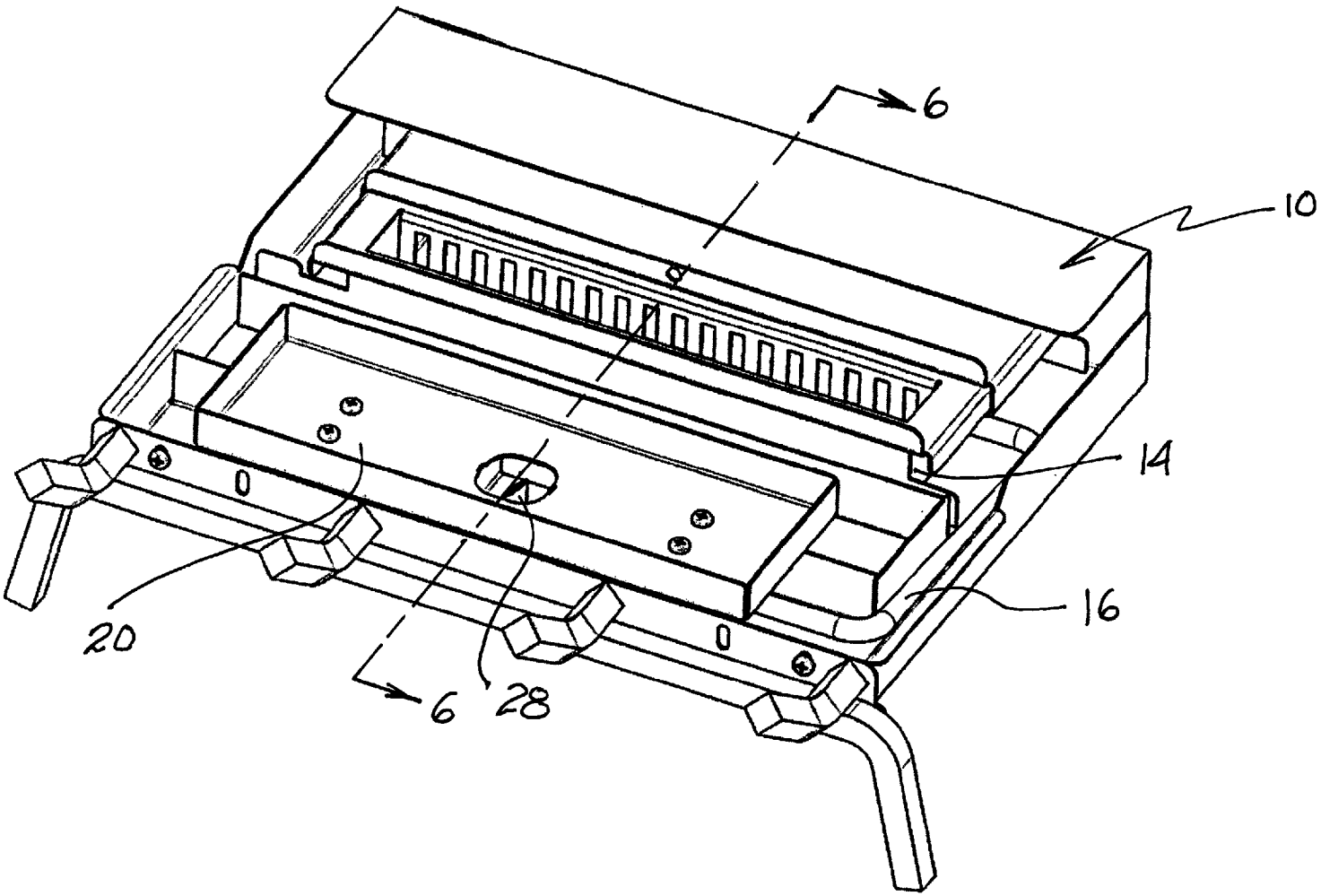
FIG. 1 is a front perspective schematic view of a first embodiment of a liquid fuel burner assembly incorporating features of the invention.
Figure 2:
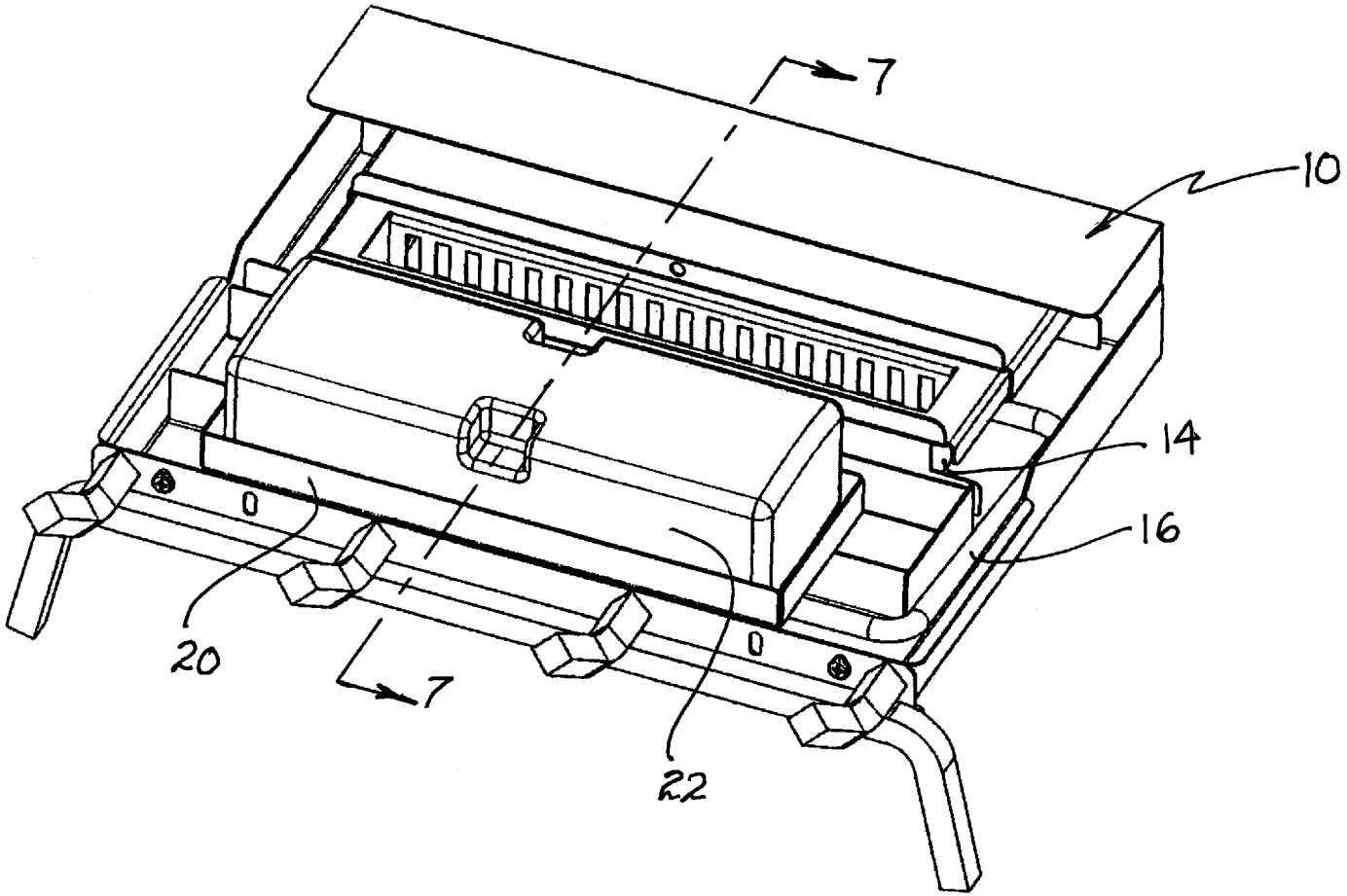
FIG. 2 is a front perspective schematic view of the liquid fuel burner assembly of FIG. 1 including a fuel delivery bottle.
Figure 3:
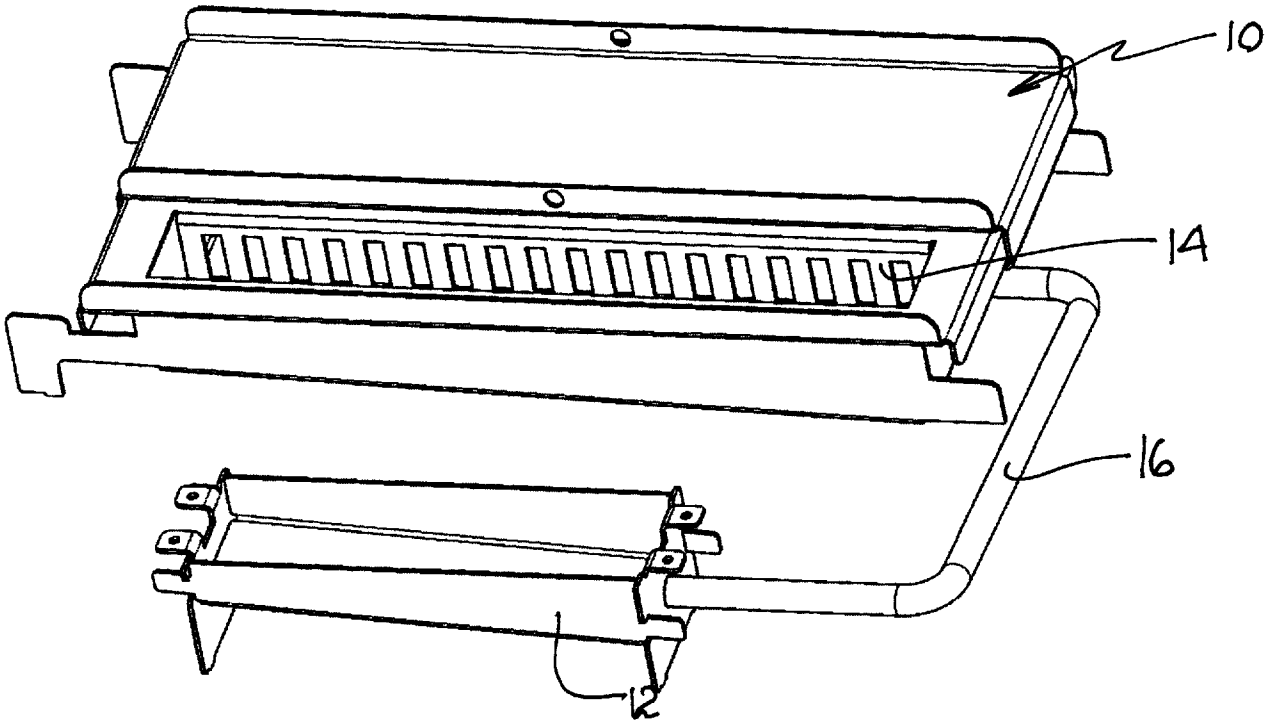
FIG. 3 is a front perspective schematic view of the burner and fuel reservoir portions of FIG. 1.
Figure 13:
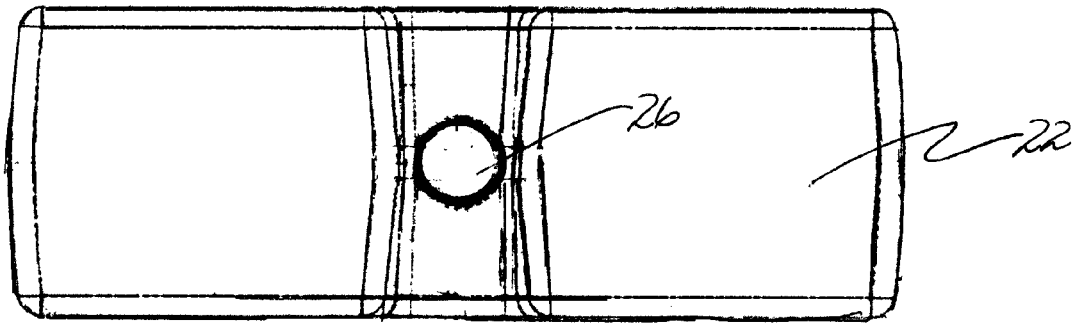
FIG. 13 is a top schematic view of a bottle containing a liquid fuel for placement in the burner assemblies of FIGS. 1-12.
Figure 14:
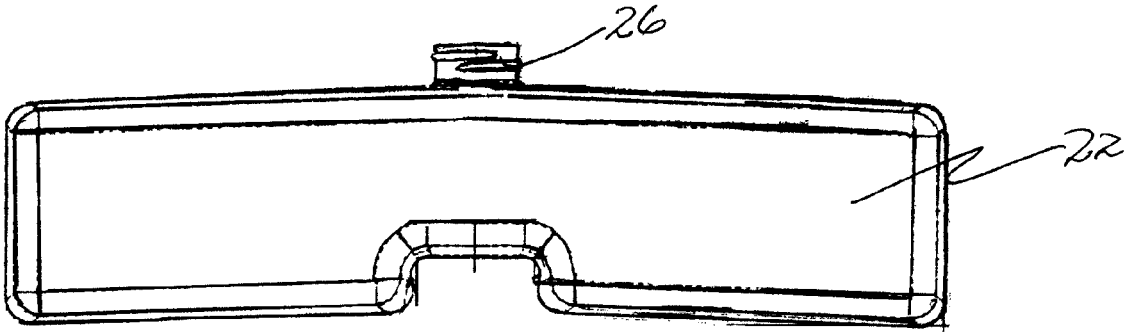
FIG. 14 is a front schematic view of a bottle containing a liquid fuel for placement in the burner assemblies of FIGS. 1-12.
Figure 15:
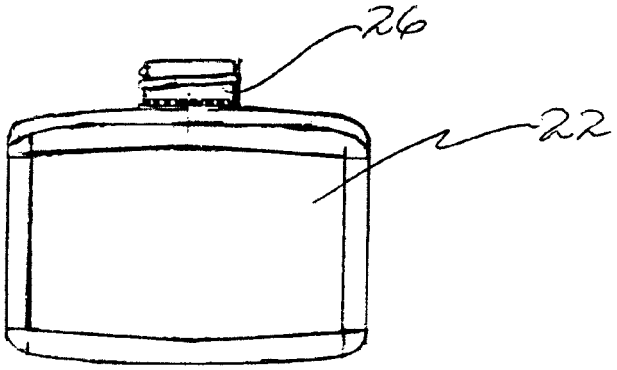
FIG. 15 is end schematic view of a bottle containing a liquid fuel for placement in the burner assemblies of FIGS. 1-12.

Referring to FIGS. 1-4 and as best shown in FIG. 3, a liquid fuel burner assembly 10 includes a fuel receiving reservoir 12, a burner 14 connected to the fuel receiving reservoir 12 by a conduit, preferably a tube 16 or trough, and a bottle receiving tray 20. While a structure referred to as a "tray" is shown, the tray merely identifies a location for placement of the bottle and a physical structure such as a tray is not necessary. A bottle 22 containing the liquid fuel 24, such as shown in FIGS. 13-15, is designed to be placed on the bottle receiving tray 20 with an access port or pouring spout 26 in the bottle 22 downwardly positioned over the fuel receiving reservoir 12. The term "bottle" is used to indicate any container for the liquid fuel and it is not intended to limit the disclosure to a glass or plastic container. The assembly may include a piercing implement 28 as shown in FIGS. 2, 5, 7, 8 and 9 or other suitable bottle openers so that when a sealed bottle 22 is placed on the tray 20 the pouring spout 26 is opened allowing the liquid fuel to pour out of the bottle 22 and into the fuel receiving reservoir 12. Alternatives include but are not limited to valves, removable plates, or other devices intended to prevent premature delivery of the fluid from the bottle.

Figure 4:
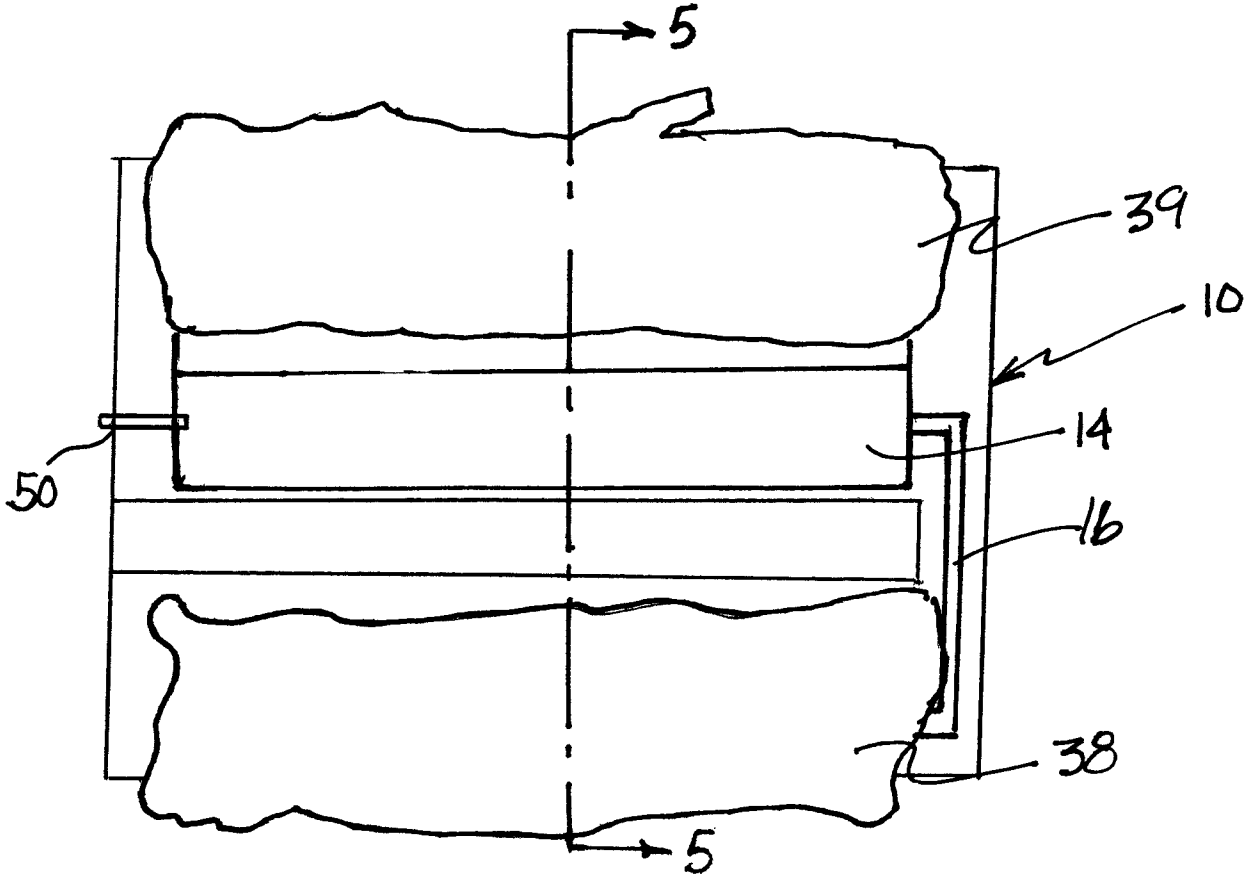
FIG. 4 is a top schematic view of the liquid fuel burner assembly of FIG. 1 with artificial logs placed on top of the burner and fuel reservoir assembly.

FIG. 4 is a top view of the liquid fuel burner assembly 10 of FIGS. 1-3 with artificial logs 38, 39, preferably constructed of a ceramic material or other non-flammable material, formed to resemble real wooden logs. As best shown in FIG. 4, the burner 14, which may comprise one or more compartments, is positioned to provide a burning area between the rear log 38 and the front log 39. When the vapor 32 over the liquid fuel 24 is ignited to produce a flame, as described below, the appearance of the assembly appears to an observer as a natural log fire.

Figure 5:
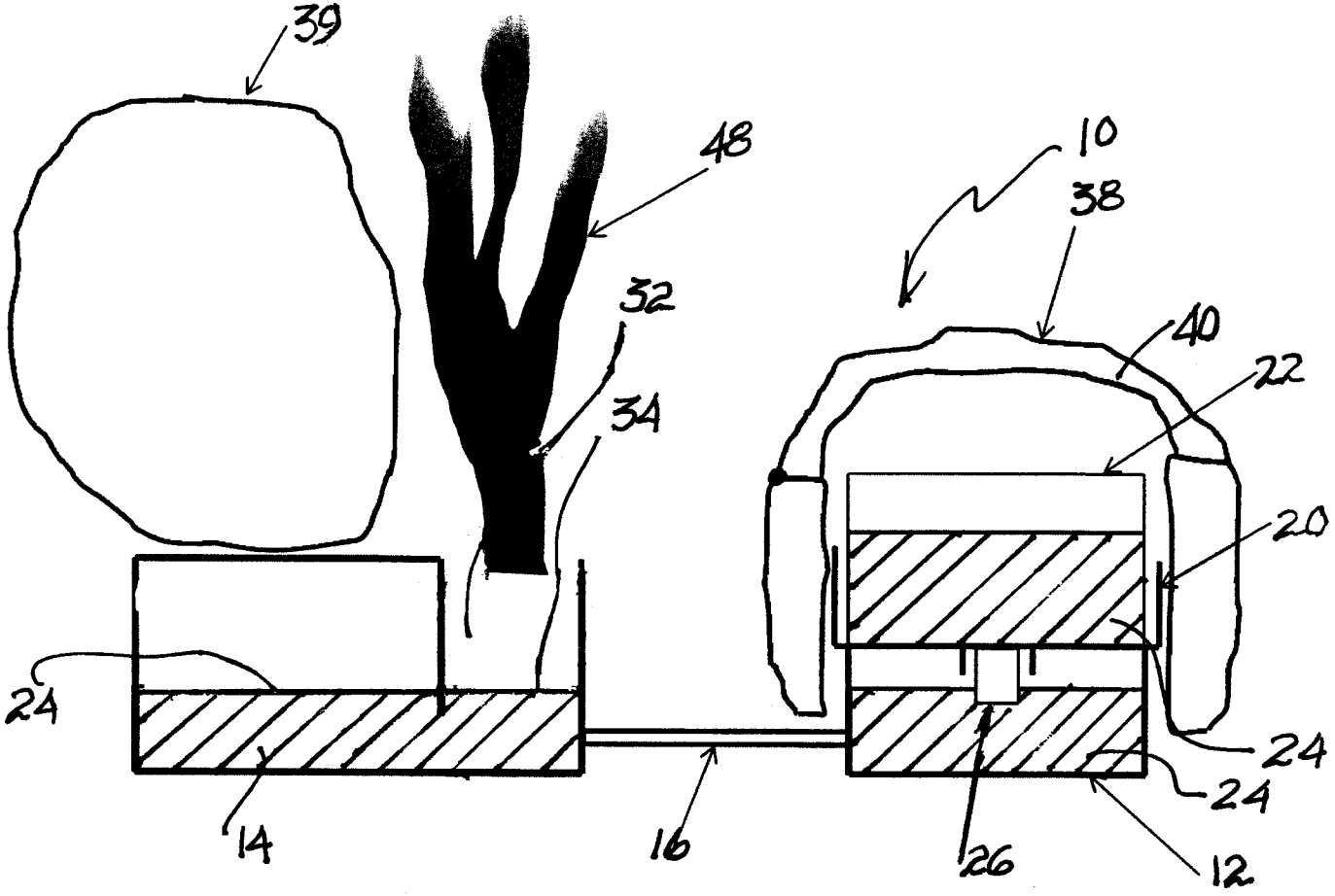
FIG. 5 is a left end schematic sectional view taken along line 5-5 of FIG. 4 showing the liquid fuel burner assembly of FIG. 1 in operation.

FIG. 5 is a cross sectional view taken along line 5-5 of FIG. 4, providing a schematic representation of the liquid fuel burner assembly 10 in operation. A flame 48 is shown emanating from vapors above the fuel 24 residing in the burner 14 at a location between the front and rear artificial logs 38, 39. One skilled in the art will recognize that while the disclosed embodiment shows two artificial logs, it is contemplated that more than two logs and/or more than two burners 30 can be used to provide a larger appearing fire.

Figure 6:
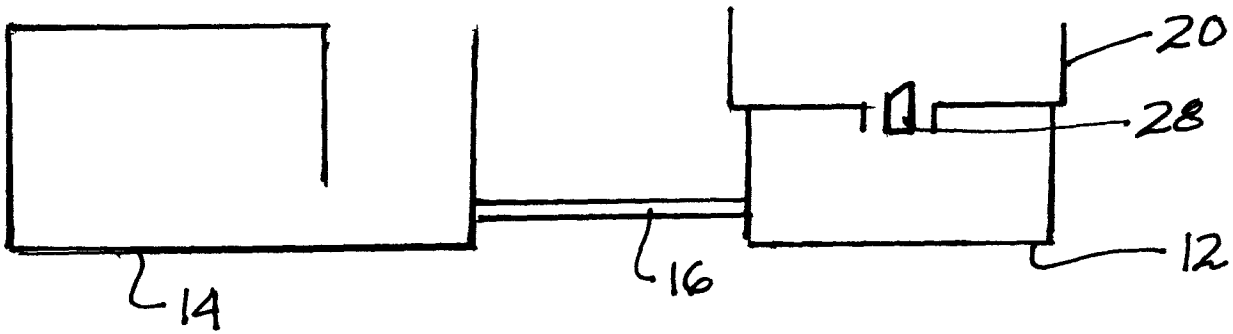
FIG. 6 is a left end schematic sectional view taken along line 6-6 of FIG. 1 showing the liquid fuel burner and fuel reservoir assembly of FIG. 1 prior to installation of a fuel bottle.
Figure 7:
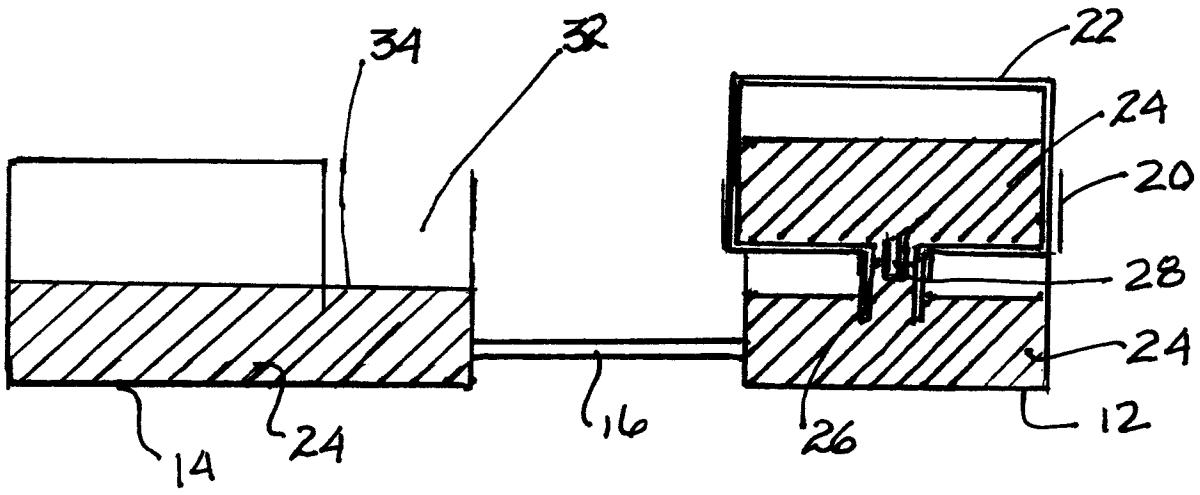
FIG. 7 is a left end schematic sectional view taken along line 6-6 of FIG. 1 showing the liquid fuel burner and fuel reservoir assembly of FIG. 1 after installation of a fuel bottle but prior to ignition.

FIG. 6 shows one particular embodiment of a liquid fuel burner assembly 10 prior to placement of the bottle 22. On placing the filled fuel bottle 22 on the bottle receiving tray 20 the sealed bottle access port 26 is pierced by the piercing element 28. Fuel 24 then flows from the bottle 22 into the fuel receiving reservoir 14 and then through tube 16 and into a burner 14. Flow into the reservoir 12 stops as a result of the creation of a lesser pressure space (a vacuum) that forms in the bottle 22 in the air space over the fuel as the fuel flows out of the bottle and the fuel level in the reservoir 12 is above the lip of the pouring spout/access port 26. This arrangement allows the burner 14 to fill only to a preset level slightly above the bottom edge of the access port 26, which in turn provides a fuel level in the burner 14 approximating the height of the fuel 24 in the fuel receiving reservoir 12 as shown in FIG. 7.

Figure 8:
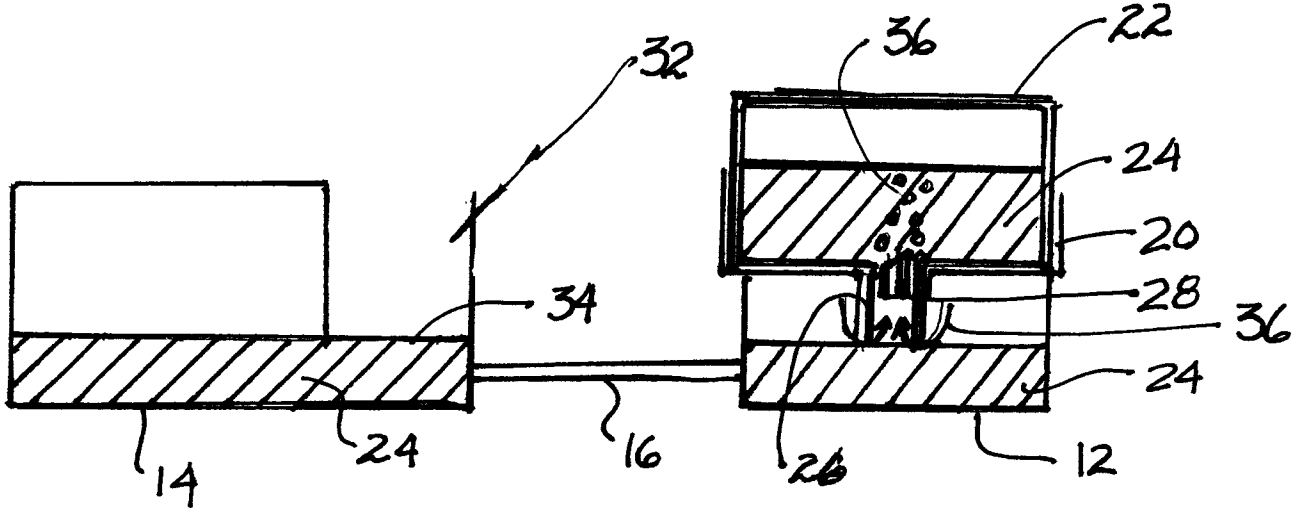
FIG. 8 is a left end schematic sectional view taken along line 6-6 of FIG. 1 showing the liquid fuel and fuel reservoir assembly of FIG. 1 after burning for a period of time.
Figure 9:
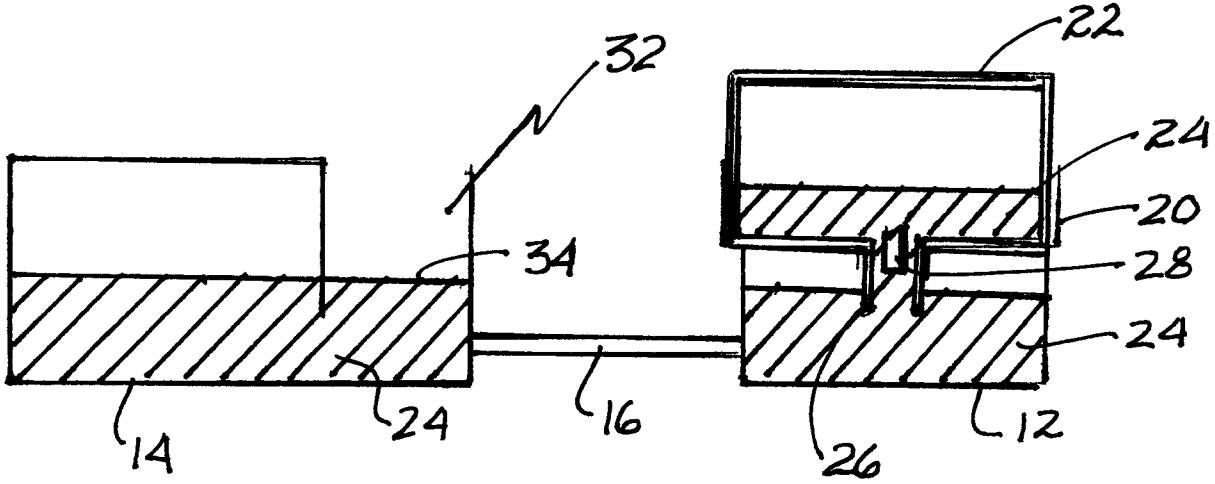
FIG. 9 is a left end schematic sectional view taken along line 6-6 of FIG. 1 showing the liquid fuel burner and fuel reservoir assembly of FIG. 1 after burning for an additional period of time.

Flammable vapor 32 accumulates above the surface of the liquid fuel in the burner 14; once ignited the flame then emanates from the vapor 32 at a distance above the fuel surface 34 as shown in FIG. 5. The vapor can be lit using any flame source, such as a match, propane or butane lighter, spark igniter, heated surface such as an electrically heated coil, etc. FIG. 4 shows an optional access port 50 for insertion of the ignition means into the vaporized fuel. In the alternative, the access port 50 may instead be a built-in igniter such as a spark generator or an electrically heatable coil. As the fuel 24 in the burner is consumed by burning of the vapors, the fuel level in the burner 14 begins to drop. This in turn causes the fuel level in the fuel receiving reservoir 12 to likewise drop slightly, such as shown in FIG. 8, allowing air 36 (as represented by the arrows in FIG. 8) to flow into the bottle 22, thus allowing more fuel 24 to flow from the bottle to replenish the fuel levels in the reservoir 12 and burner 14 until the fuel in the reservoir 12 once more covers the bottle opening (FIG. 9), thus stopping fuel flow. The fuel levels shown in the drawings are exaggerated for clarity; in actual operation the fuel level stays in a narrow range just below to just above the lip of the access port opening. This cycle continues until the bottle 22 is empty, at which point another bottle 22 can be placed into the bottle receiving tray 20, thus refilling the burner 14. Changing bottles does not require waiting until the flame is extinguished. Prior art devices usually required complete consumption of the fuel in the burner, and the liquid fuel burner assembly 10 to have cooled down. As taught herein, a bottle of fuel typically containing 0.5 to 2 liters of fuel can be installed in the burner assembly to support a burn for at least about 1-4 hours. However, larger containers can be used and the assembly described herein is not limited by the size of the containers. A new bottle can be installed once the previously installed bottle is empty, so that the flame can burn continuously. The fire time is not limited in time to a burn from a single bottle of fuel; it is limited only by the quantity of fuel bottles available. This design also allows the burner to be much smaller than most prior burners as the size of the burner does not depend on the size of the fuel reservoir necessary to hold enough fuel for a sustained burn. Having a smaller burner results in a smaller mass, thus allowing the burner to heat up faster so that the flame reaches its full effect much faster than prior designs.

Figure 12:
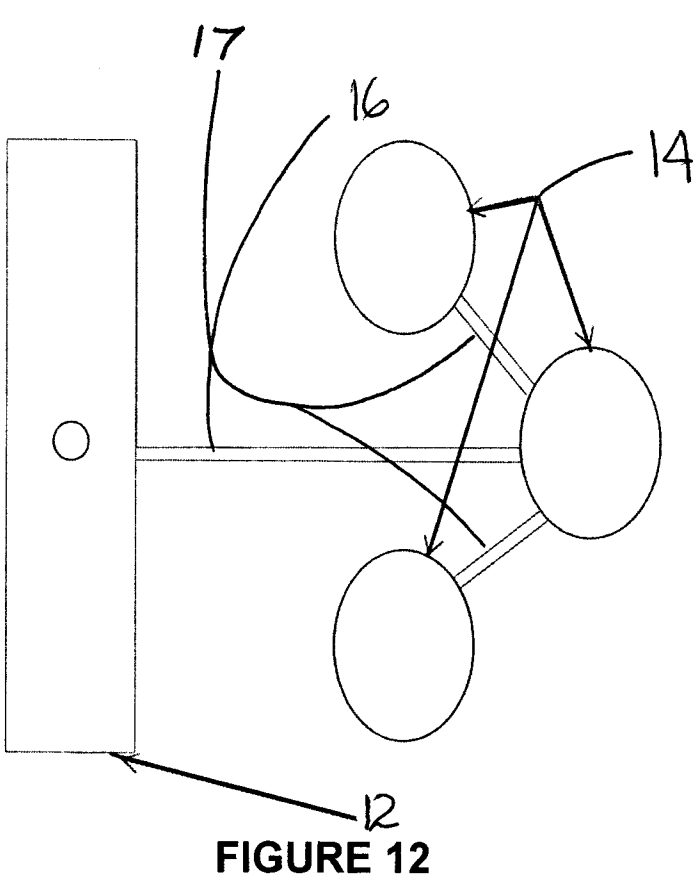
FIGS. 11 and 12 are schematic drawing of second and third embodiments of the liquid fuel burner assembly including multiple burners.
Figure 11:
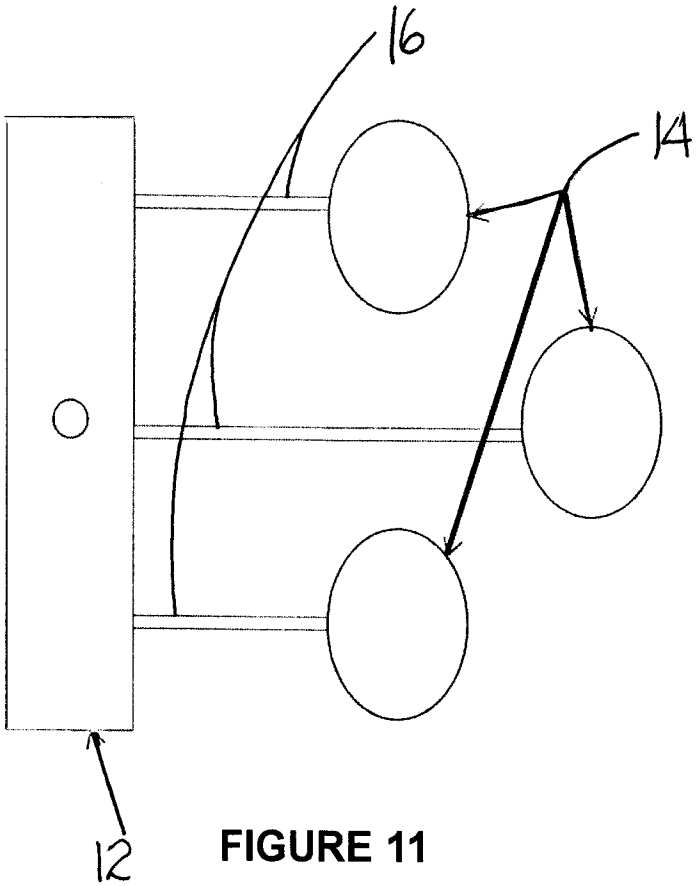

The embodiment of FIGS. 1-9 includes a large burner 14 which is divided into two compartments. However, single compartment burners are also suitable. FIGS. 11 and 12 are schematic drawings of a second and third embodiment including multiple smaller burners 14 connected to a fuel receiving reservoir 12. In FIG. 11 three burners 14 are spaced from the fuel reservoir 12, each burner receiving the liquid fuel through a dedicated tube 16. The arrangement in FIG. 12 has a single tube 16 attached to the reservoir 14 that tube then being connected to the auxiliary tubes 17 for feeding the individual burners. However, the invention set forth herein is not limited to the embodiments shown and one skilled in the art, based on the teachings herein will recognize that numerous variations with multiple burners, feed tubes and fuel reservoirs can be utilized to move the flammable liquid from the storage bottle to the burner and all of these embodiments will allow the use of multiple bottles of liquid fuel, all of which can be readily replaced without interrupting the flame in the one or more burners. While not shown, it is contemplated that multiple fuel bottles and multiple fuel reservoirs can likewise be used to fuel one or more burners. Further, the multiple burners can be positioned so that one or more burners will contain fuel after the fuel in the other burners is depleted, to provide the visible indication that it is time to replenish the fuel supply.

The embodiment shown in the Figures allows for placement of the fuel bottle and fuel receiving reservoir in the liquid fuel burner assembly 10 but at a location where it is also protected from the heat of the flame. To further protect the fuel bottle 22 and liquid fuel burner assembly 10 from the open flame in the embodiment of FIGS. 1-9, they are covered by a hollow artificial log 38 made from ceramic fiber with an openable cover such as shown in FIGS. 4 and 5. The embodiment shown has an opening in the top of the log that is covered by a hinged door 40. A log 42 with a similar outward appearance also sits adjacent and behind the burner top 18. When the door 40 is closed the log 38 looks like a conventional log in front of the fire. When a fuel bottle 22 needs to be placed in the burner assembly 10 the door 40 is opened by swinging upward or rearward so that it also creates a protective barrier from the flames. The used, substantially empty bottle 22 is removed and the new bottle 22 is inserted in its place and pushed down so that the piercing implement 28 punctures the sealed access port 26, thus allowing fuel to flow into and replenish the reservoirs 12, 14.

Figure 10:
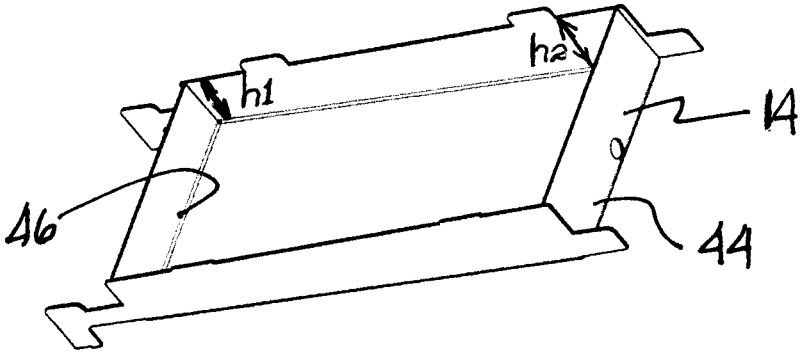
FIG. 10 is a front schematic perspective view of the burner without the burner top.

FIG. 10 illustrates a further optional feature of the liquid fuel burner assembly 10 wherein the burner 14 has a sloped bottom 42 such that when the fuel is almost totally consumed the remaining fuel resides in the lowest end 44 of the tray, said lowest end constituting a fuel well. As a result the flame, which emanates from the vapor over the remaining fuel in the well, is concentrated at the lowest end 44 of the tray 42, there being no fuel at the opposite, higher end 46. An observer of the flame is then alerted by the flame burning at only one end of the burner 14 above the fuel well that almost all of the fuel 24 has been consumed and it is time to replace the empty fuel bottle 22 with a full bottle, thus replenishing the fuel supply in the burner 14.

While one embodiments disclosed herein describes a device and method for providing a continuously burning flame in a fireplace enclosure, including artificial logs, one skilled in the art will recognize that the assembly of various components and their method of use is not restricted to placement within an enclosure and can be readily adapted to use in fire pits and decorative flame display arrangements both indoors and outdoors. For example, FIGS. 11 and 12 illustrate alternative embodiments including multiple burners. Based on the teachings herein multiple alternative arrangements can be assembled to receive one or more bottles of liquid fuel in one or more locations, and then distribute that liquid fuel to one or more burners in a manner that provides for replacing the fuel source while the flame is burning without a need to first extinguish the flame or causing a fire hazard from fuel vapors during the refilling procedure.

We claim:

1. An assembly for creating a fire display from a liquid fuel comprising:

a) one or more fuel receiving reservoirs connected to one or more burners by one or more conduits, the conduits providing flow channels from said one or more reservoirs to said one or more burners for liquid fuel contained in said reservoirs, the fuel receiving reservoirs and the burners being spaced apart and positioned to provide equal fuel levels in the reservoir and burner, b) a bottle receiving tray configured to receive a container of liquid fuel, and c) a container of liquid fuel, the bottle receiving tray positioned at a suitable distance from the burner to allow addition of liquid fuel to the system without ignition thereof by the flames constituting the fire display during said addition and to provide delivery of the liquid fuel in the container to the fuel receiving reservoir upon placement of the container in or on the bottle receiving tray, said bottle receiving tray including a piercing element, and the container of the liquid fuel having a sealed access port, such that placement of the container in or on the bottle receiving tray causes the piercing element to penetrate the sealed access port.

2. The assembly of claims 1 wherein said bottle containing the liquid fuel is designed for placement in or on the bottle receiving tray with an access port positioned over the piercing element with said piercing element oriented to puncture the sealed access port on the bottle so as to dispense the liquid fuel in the bottle into the fuel receiving reservoir, said fuel in turn flowing through the conduit and into the burner.

3. The assembly of claim 1 further including two or more noncombustible logs mounted on top of the burner, a first noncombustible log positioned on a rearward portion of, and extending across a width of the burner and a second noncombustible log positioned on a forward portion of the burner, said first noncombustible log removably covering the bottle receiving tray and the bottle positioned in the bottle receiving tray.

4. The assembly of claim 1 wherein the liquid fuel comprises an ester oil, plant oil, alcohol, paraffinic compositions or petroleum product.

5. The assembly of claim 1 wherein the liquid fuel is an alcohol solution.

6. The assembly of claim 1 wherein the liquid fuel is denatured ethanol.

7. The assembly of claim 1 wherein the burner has at least a portion of a bottom surface thereof that is disposed at a point lower than the remainder of the bottom surface to provide a fuel well.

8. The assembly of claim 1 including more than one burner wherein at least one burner is configured so that the liquid fuel contents thereof dissipates prior to one or more of the other burners.

9. The assembly of claim 1 wherein the bottle receiving tray comprises a bottle receiving tray.

10. The assembly of claim 1 wherein the one or more burners comprise a liquid fuel burner assembly wherein one or more burners therein have at least a portion of a bottom surface thereof that is disposed at a point lower than the remainder of the bottom surface to provide a fuel well.

11. The assembly of claim 10 for creating a fire display the assembly comprising one or more burners and one or more fuel receiving trays, one or more containers of a liquid fuel positioned in said one or more fuel receiving trays, said one or more fuel receiving trays and containers for fuel positioned therein covered by an openable fire retardant enclosure.

12. The assembly of claim 11 wherein said openable fire retardant enclosure is an artificial log.

13. The assembly of claim 1 for creating a fire display, the assembly comprising one or more burners and one or more fuel receiving trays, one or more containers of a liquid fuel positioned in said one or more fuel receiving trays, said one or more fuel receiving trays and containers for fuel positioned therein covered by an openable fire retardant enclosure.

* * * * *